US007690090B2

(12) United States Patent
Swain et al.

(10) Patent No.: US 7,690,090 B2
(45) Date of Patent: Apr. 6, 2010

(54) ONE-SIDED RAIL SLIDER FOR RECLOSABLE ZIPPER

(75) Inventors: Henry Swain, Whitehouse Station, NJ (US); Edward Gayowski, Colleyville, TX (US); Stanley Piotrowski, Addison, IL (US); Lynnette Dehnke, Arlington Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 565 days.

(21) Appl. No.: 11/634,447

(22) Filed: Dec. 6, 2006

(65) Prior Publication Data

US 2008/0134478 A1 Jun. 12, 2008

(51) Int. Cl.
*A44B 19/16* (2006.01)

(52) U.S. Cl. ..... 24/400

(58) Field of Classification Search ..... 24/585.12, 24/399, 400, DIG. 39, DIG. 40, DIG. 50; 383/61.2, 61.3, 63, 64
See application file for complete search history.

(56) References Cited

U.S. PATENT DOCUMENTS 2,581,604 A 1/1952 Roehri
5,636,415 A 6/1997 James
2002/0184740 A1 12/2002 Meager

FOREIGN PATENT DOCUMENTS

| | | |
|---|---|---|
| DE | 1435792 | 12/1968 |
| FR | 2784874 | 4/2000 |
| GB | 704 518 | 2/1954 |
| WO | WO 9220252 A1 * | 11/1992 |

* cited by examiner

*Primary Examiner*—James R Brittain
(74) *Attorney, Agent, or Firm*—Day Pitney LLP

(57) ABSTRACT

The disclosure relates to a slider and a reclosable zipper, particularly a zipper with first and second profiles for water-tight vessels, packages or similar devices. The slider is generally C-shaped with an upper arm, a lower arm, and a support wall in between. The support wall includes a groove which captures a rail formed on the first profile so that the slider can slidably move along the rail, riding the first profile. The lower arm includes separator blades which separate the first and second profiles when the slider is moved in the opening direction so as to urge the second profile between the upper and lower arms. When the slider is moved in the closing direction, the second profile travels between the upper and lower arms and is urged into engagement with the first profile by the upper arm. At the final closing position, the slider is stabilized or parked within a cut-out portion of the second profile.

20 Claims, 3 Drawing Sheets

ONE-SIDED RAIL SLIDER FOR RECLOSABLE ZIPPER

BACKGROUND OF THE INVENTION

1. Field of the Invention

The present invention relates to a one-sided rail slider for a watertight reclosable zipper. The design of the one-sided rail slider eliminates a leak path which is found in prior art slider designs for such watertight reclosable zippers.

2. Description of the Prior Art

Examples of watertight reclosable zippers 100 for reclosable packages and similar applications are shown in FIGS. 1 and 2. FIG. 1 illustrates an embodiment with two tracks while FIG. 2 illustrates an embodiment with three tracks. The style of this zipper is oriented primarily in the horizontal position as shown in FIGS. 1 and 2. When the zipper profiles 102, 104 are completely engaged, a watertight seal is formed. For ease of opening and closing, a slider is often employed. However, the addition of prior art sliders, such as shown in FIGS. 3 and 4, to these embodiments creates a leak path which impairs the watertight configuration. The sliders of FIGS. 3 and 4 have an S-shape which is used to engage both sides of the zipper. However, the dividing center or bridging elements creates a path from one side of the zipper to the other, thereby resulting in a leak path.

OBJECTS AND SUMMARY OF THE INVENTION

It is therefore an object of the present invention to create a slider for watertight zippers which maintains the watertight configuration and does not create a leak path from one side of the zipper to the other.

This and other objects are attained by providing a slider which engages one rail formed on a first zipper profile, and which removes the bridging element thereby eliminating the leak path through the zipper. The slider engages the rail and slidably travels on one side of the first zipper profile and separates the first and second zipper profiles with two blade-like elements. The slider has a general C-shaped cross section allowing it to engage between the zipper profiles while riding on the top of the first zipper profile. The underside of an upper arm of the slider further includes an angled element to compensate for opening and closing forces. The angled element reduces friction and the force required to move the slider. The second zipper profile further includes a cutout region to park the slider in the closed position. In this position, the slider disengages from the second zipper profile so as to further increase the watertight characteristics of the zipper.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
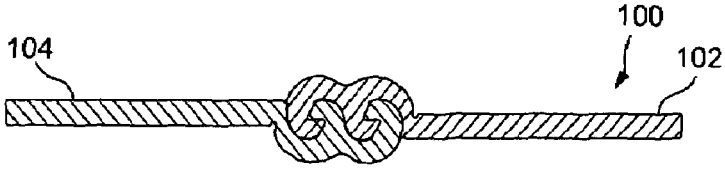
FIG. 1 PRIOR ART
FIG. 1 is a cross-sectional view of a first prior art zipper.
Figure 2:
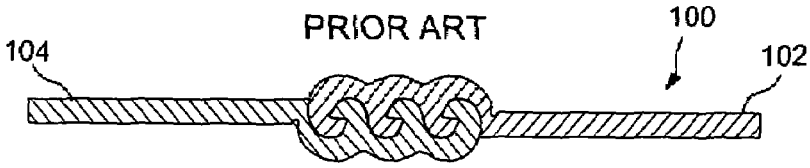
FIG. 2 PRIOR ART
FIG. 2 is a cross-sectional view of a second prior art zipper.
Figure 3:
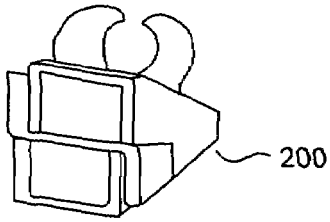
FIG. 3 PRIOR ART
FIG. 3 is a perspective view of a first typical slider used with the prior art zipper of FIGS. 1 and 2.
Figure 4:
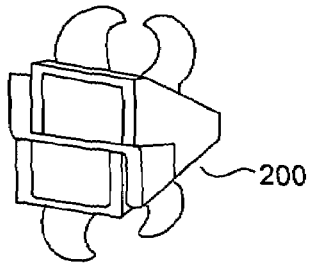
FIG. 4 PRIOR ART
FIG. 4 is a perspective view of a second typical slider used with the prior art zipper of FIGS. 1 and 2.
Figure 5:
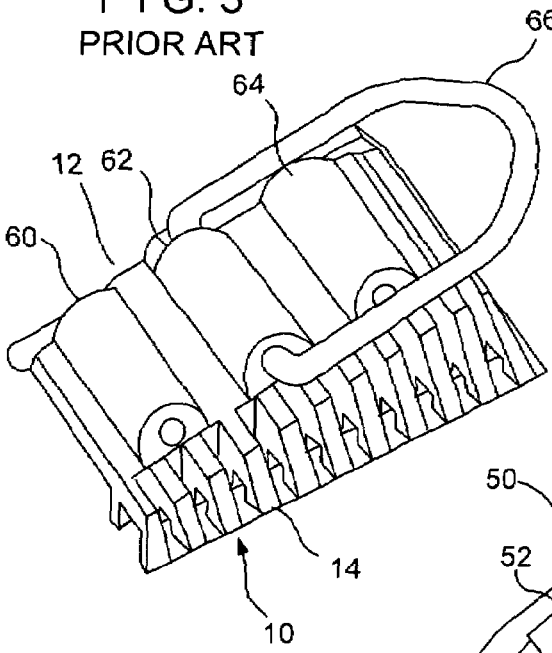
FIG. 5 is a top perspective view of the slider of the present invention.
Figure 6:
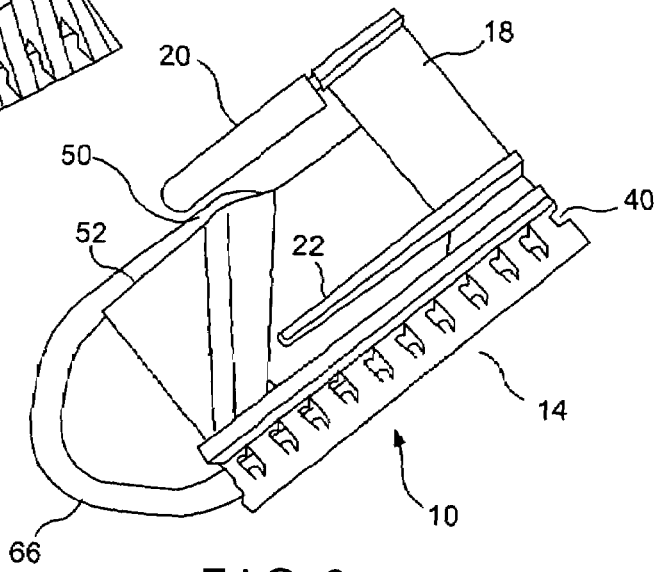
FIG. 6 is a bottom perspective view of the slider of the present invention.
Figure 7:
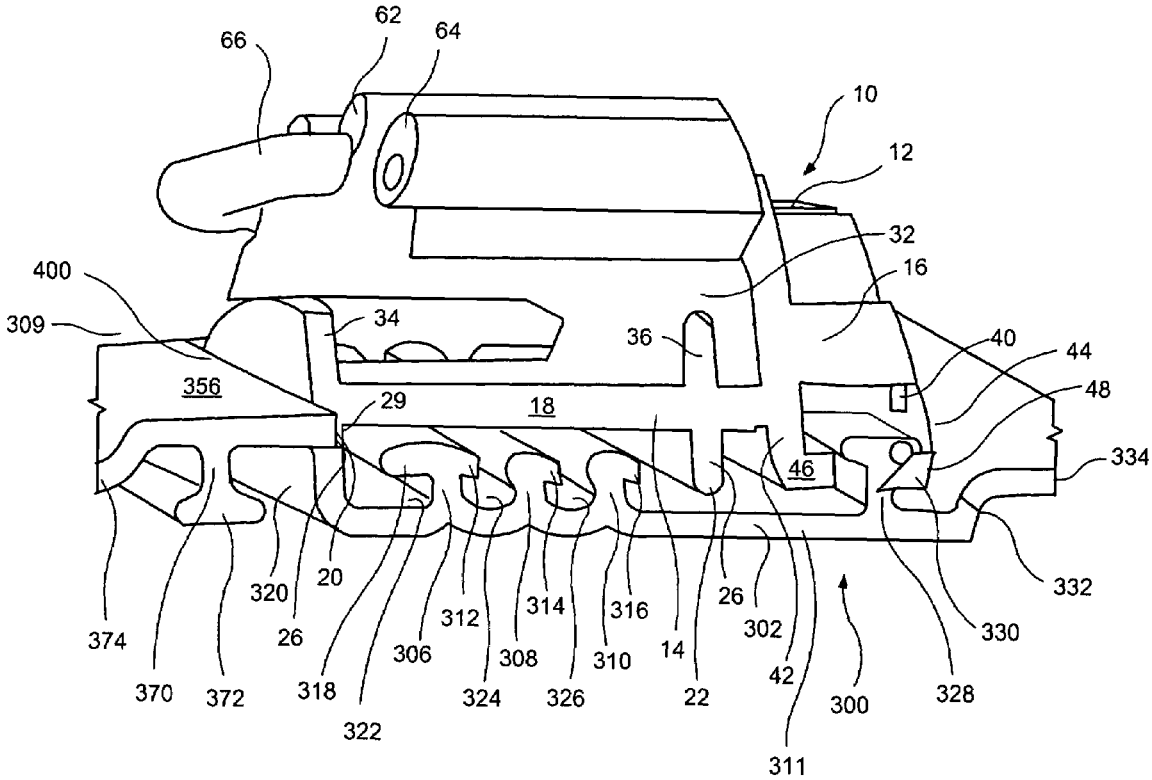
FIG. 7 is a perspective view of the slider and zipper of the present invention, shown with the slider in the parked position in the zipper.
Figure 8:
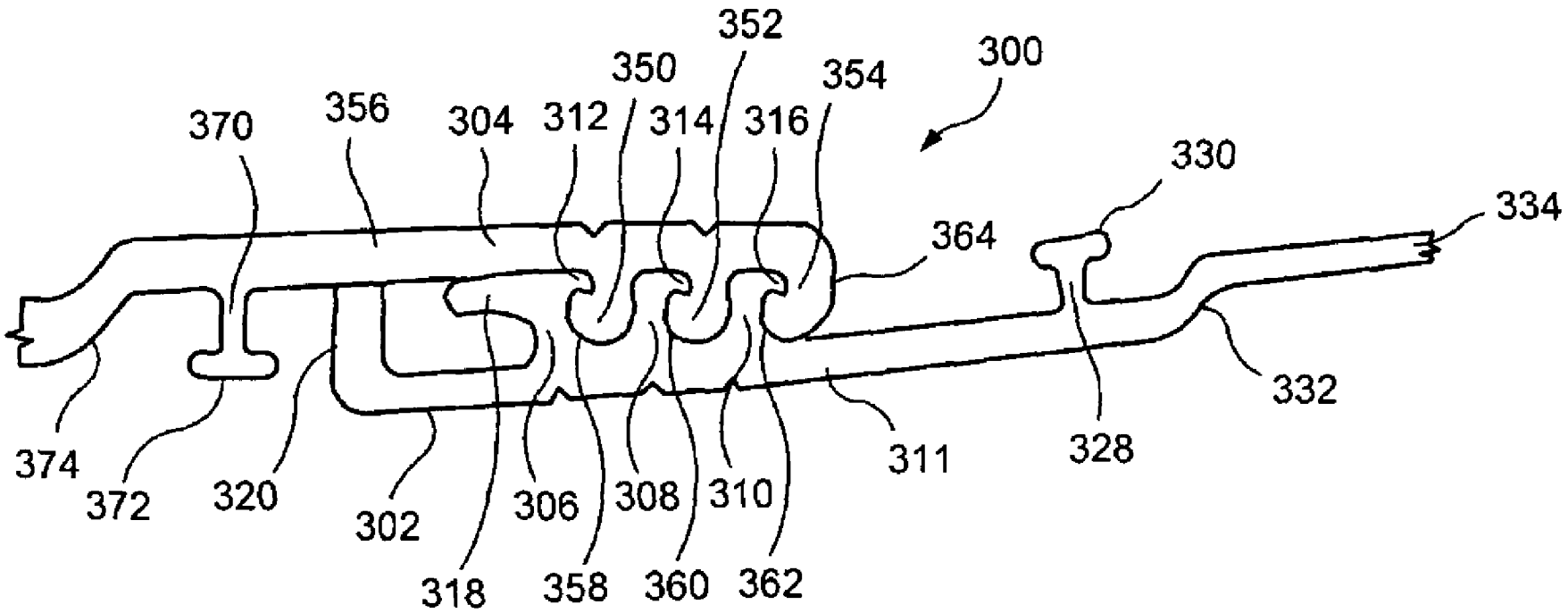
FIG. 8 is a cross-sectional view of the engaged zipper of the present invention.

Referring now to the drawings in detail wherein like numerals indicate like elements throughout the several views, one sees that FIGS. 5-7 illustrate the slider 10 of the present invention in various perspective views while FIG. 8 illustrates a cross section of the zipper 300 of the present invention.

The zipper 300 adapted to slider 10 is disclosed in FIGS. 7 and 8. Zipper 300 includes first profile 302 and second profile 304. First profile 302 includes first, second, and third interlocking parallel tracks 306, 308, 310, formed on first profile base 311, with respective detent hooks 312, 314, 316 formed on distal ends thereof. Additionally, first interlocking track 306 includes extension 318. The edge of first profile include upwardly extending lip 320. First channel 322 is formed between upwardly extending lip 320 and first interlocking track 306. Second channel 324 is formed between first and second interlocking tracks 306, 308 and third channel 326 is formed between second and third interlocking tracks 308, 310.

First slider rail 328, including expanded distal end 330, is formed offset from and parallel to interlocking tracks 306, 308, 310. Optional ridge 332 raises the level of first zipper flange 334 with respect to first profile base 311. This allows the flanges of first and second profiles 302, 304 to be formed at substantially the same level.

Second profile 304 includes fourth, fifth and sixth interlocking parallel tracks 350, 352, 354, formed on second profile base 356, with respective fourth, fifth and sixth detent hooks 358, 360, 362 on detent ends thereof. As shown in FIG. 8, in the interlocked position, fourth interlocking parallel track 350 is inserted within second channel 324 of first profile 302 such that first and fourth detent hooks 312, 358 interengage, fifth interlocking parallel track 352 is inserted within third channel 326 of first profile 302 such that second and fifth detent hooks 314, 360 interengage, and sixth interlocking parallel track 352 extends immediately adjacent to third interlocking parallel track 310 so that third and sixth detent hooks 316, 362 interengage. Additionally, profile end surface 364 is formed by the lateral side of sixth interlocking parallel track 352.

Second slider rail 370, including expanded distal end 372, is formed offset from and parallel to interlocking tracks 348, 350, 352. This allows a second slider (not shown) to operate on the opposite side of zipper 300, to allow dual access (i.e., access at both ends), much like a duffel bag, or similar configurations. Optional ridge 374 lowers the level of second zipper flange 376 with respect to second profile base 380. This allows the flanges of first and second profiles 302, 304 to be formed at substantially the same level.

Additionally, as shown in FIG. 7, second profile 304 includes cut-out portion 400 to provide a location to stabilize or park slider 10 when the zipper 300 is in the fully closed configuration.

As can be seen best from FIG. 7, slider 10 has a general C-shaped cross section with upper arm 12 and lower arm 14, generally parallel to each other, and support wall 16 therebetween. Lower arm 14 is formed from cross-bar 18 with first and second separating blades 20, 22 (see FIG. 6) extending therefrom. The downwardly extending rear portions of first and second separating blades 20, 22 form first and second lower support elements 24, 26 (see FIG. 7). First lower support element 24 rides on upwardly extending lip 320 while second lower support element 26 rides on first profile base 311. The separating function of slider 10 is performed by first and separating blades 20, 22 being inserted between first and second zipper profiles 302, 304 so that second zipper profile 304 rides up over separating blades 20, 22 and exits through the gaps 30, 32 formed between respective first and second upper support elements 34, 36 (likewise formed from upwardly extending rear portions of first and second separating blades 20, 22) and upper arm 12.

The lower area of support wall 16 includes rail attachment groove 40 formed between first and second groove walls 42, 44, which include respective first and second lower inwardly extending flanges 46, 48. Rail attachment groove 40 captures first slider rail 328 so that lower inwardly extending flanges 46, 48 of groove walls 42, 44 ride on first profile base 311, allowing slider 10 to ride first profile 302 in either an opening direction or a closing direction.

Upper arm 12 extends from an upper end of support wall 16 parallel to lower arm 14 thereby forming gaps 30, 32. As shown in FIG. 6, a lower side of upper arm 12 includes angled element 50 to compensate for opening and closing forces. Angled element 50 reduces friction and the force required to move slider 10. As shown in FIG. 6, upper side of upper arm 12 include three transverse passageways 60, 62, 64 for engaging handle 66.

When slider 10 is moved in the opening direction (away from the viewer in FIG. 7), first and second separating blades 20, 22 are inserted between first and second interlocking profiles 302, 304 so that slider 10 rides on first interlocking profile 302 (as guided or constrained by first slider rail 328) while second interlocking profile 302 rides above first and second separator blades 20, 22 to extend through gaps 30, 32 formed between upper and lower arms 12, 14. When slider 10 is moved in the closing direction (toward the viewer in FIG. 7), second profile 304 rides down first and second separator blades 20, 22 and is urged against first profile 302 by upper arm 12 so that first and second interlocking profiles 302, 304 are interlocked in the position shown in FIG. 8. When slider 10 has reached its fully closed position, slider 10 is stabilized or parked within cut-out section 400 of second profile 304 as shown in FIG. 7.

In the illustrated embodiment, slider 10 is always on an upper side of first profile 302 and does not extend to the lower side of first profile 302.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper including:

a first profile with a first interlocking element and a slider rail;

a second profile with a second interlocking element; and a slider including a separator element inserted between the first and second profiles, the separator element including a first blade positioned on a first side of the first and second interlocking elements and a second blade positioned on a second side of the first and second interlocking elements; and wherein the slider further includes a groove slidably capturing the slider rail thereby allowing the slider to move in an opening direction whereby the separator element separates the first profile from the second profile, and allowing the slider to move in a closing direction thereby interlocking the first and second interlocking elements.

2. The zipper of claim 1 wherein the slider includes an upper arm parallel to the separator element thereby forming a gap therebetween.

3. The zipper of claim 2 wherein the slider rides on a single side of the first profile and the second profile travels though the gap.

4. The zipper of claim 3 wherein the upper arm urges the second profile into engagement with the first profile when the slider is moved in the closing direction.

5. The zipper of claim 4 further including a support formed between one end of the upper arm and one end of the separator element.

6. The zipper of claim 5 wherein the support, the upper arm and the separator element form a C-shaped cross section.

7. The zipper of claim 6 wherein a side of the upper arm facing the separator element includes an element oriented diagonally with respect to the opening and closing directions.

8. The zipper of claim 7 wherein the groove is formed between first and second groove walls formed in the support.

9. The zipper of claim 8 wherein the slider rail includes an enlarged distal end and the first and second groove walls include first and second inwardly extending flanges which slidably capture the slider rail.

10. The zipper of claim 1 wherein the second profile includes a cut-out portion for stabilizing the slider when the zipper is in at least a substantially fully closed position.

11. A zipper including:

a first profile with a first interlocking element and a first engagement element;

a second profile with a second interlocking element; and a slider including a separator element inserted between the first and second profiles, the separator element including a first blade positioned on a first side of the first and second interlocking elements and a second blade positioned on a second side of the first and second interlocking elements; and wherein the slider further includes a second engagement element for slidably engaging the first engagement element thereby allowing the slider to contact one and only one side of the first profile, allowing the slider to move in an opening direction whereby the separator element separates the first profile from the second profile, and allowing the slider to move in a closing direction thereby interlocking the first and second interlocking elements.

12. The zipper of claim 11 wherein the slider includes an upper arm parallel to the separator element thereby forming a gap therebetween.

13. The zipper of claim 12 wherein the second profile travels though the gap.

14. The zipper of claim 13 wherein the upper arm urges the second profile into engagement with the first profile when the slider is moved in the closing direction.

15. The zipper of claim 14 further including a support formed between one end of the upper arm and one end of the separator element.

16. The zipper of claim 15 wherein the support, the upper arm and the separator element form a C-shaped cross section.

17. The zipper of claim 16 wherein a side of the upper arm facing the separator element includes an element oriented diagonally with respect to the opening and closing directions.

18. The zipper of claim 17 wherein the first engagement element is a slider rail and the second engagement element is a groove is formed between first and second groove walls formed in the support.

19. The zipper of claim 18 wherein the slider rail includes an enlarged distal end and the first and second groove walls include first and second inwardly extending flanges which slidably capture the slider rail.

20. The zipper of claim 11 wherein the second profile includes a cut-out portion for stabilizing the slider when the zipper is in at least a substantially fully closed position.

* * * * *